US006053015A

United States Patent [19]

Plath

[11] Patent Number: 6,053,015

[45] Date of Patent: Apr. 25, 2000

[54] CONTROL JACK FOR KNITTING MACHINES

[75] Inventor: Ernst-Dieter Plath, Albstadt, Germany

[73] Assignee: Sipra Patententwicklungs- u. Beteiligungsgesellschaft mbH, Albstadt, Germany

[21] Appl. No.: 09/164,051

[22] Filed: Sep. 30, 1998

[30] Foreign Application Priority Data

Oct. 5, 1997 [DE] Germany ..... 197 43 815

[51] Int. Cl.[7] ..... D04B 15/70; D04B 15/78

[52] U.S. Cl. ..... 66/216

[58] Field of Search ..... 66/116, 123, 216, 66/218, 219, 220, 221, 222

[56] References Cited

U.S. PATENT DOCUMENTS

| | | | |
|---|---|---|---|
| 4,905,484 | 3/1990 | Schindler . | |
| 5,076,074 | 12/1991 | Halamoda et al. | 66/123 |
| 5,327,748 | 7/1994 | Izumi et al. | 66/123 |

FOREIGN PATENT DOCUMENTS

| | | |
|---|---|---|
| 1 760 405 | 6/1971 | Germany . |
| 35 41 171 C2 | 10/1987 | Germany . |
| 37 12 673 C1 | 8/1988 | Germany . |
| 37 39 924 A1 | 2/1989 | Germany . |
| 40 07 253 A1 | 9/1991 | Germany . |
| 1452582 | 10/1976 | United Kingdom . |
| 1477890 | 6/1977 | United Kingdom . |
| 2189512 | 10/1987 | United Kingdom . |

*Primary Examiner*—Larry Worrell, Jr.
*Attorney, Agent, or Firm*—Michael J. Striker

[57] ABSTRACT

A control jack for a knitting machine has at least one selector device for knitting implements, having a front side, a rear side, a first lower lever arm having a controllable raising butt and an armature surface, a second upper lever arm having a rocking butt, and a spring arranged on the rear side for biasing the second lever arm, wherein the arms are arranged on opposite sides of a bearing point and wherein the controllable raising butt, the rocking butt and the armature surface are formed on the front side.

14 Claims, 3 Drawing Sheets

FIG.2
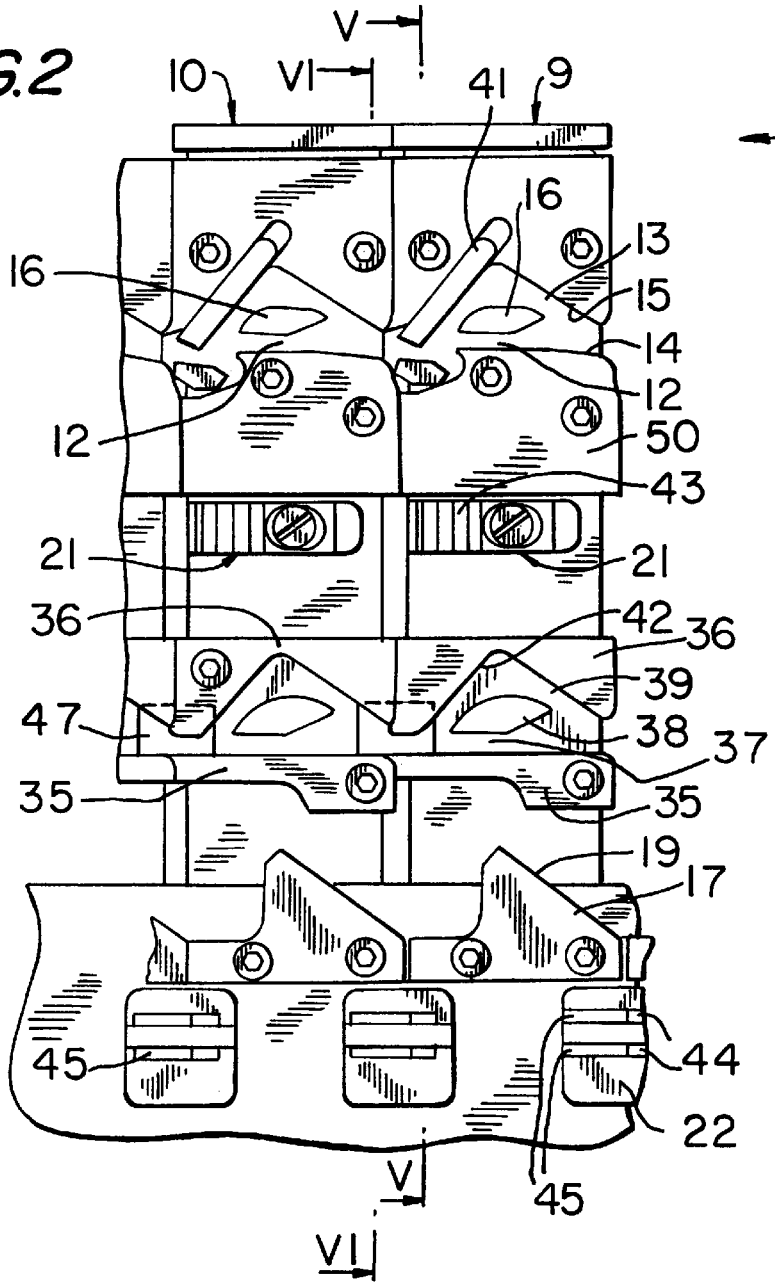
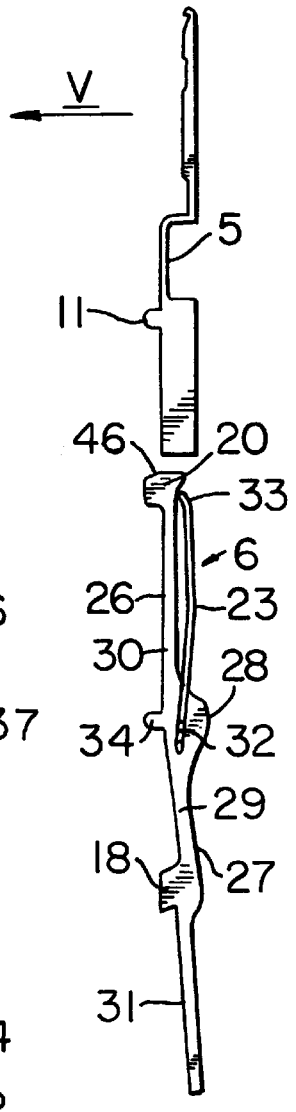
FIG.3
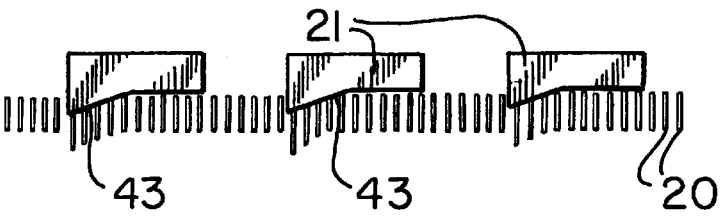
FIG.4

CONTROL JACK FOR KNITTING MACHINES

BACKGROUND OF THE INVENTION

The invention relates to a control jack for a knitting machine having at least one selector device for knitting implements. The jack comprises: a front side and a rear side, first and second lever arms arranged on opposite sides of a bearing point, wherein the first lever arm has an armature surface and the second lever arm has a rocking butt, a spring arranged on the rear side for biasing the second lever arm and a controllable raising butt, wherein the controllable raising butt, the rocking butt and the armature surface are formed on the front side.

In order to implement the so-called three-path technique, i.e. an arbitrary selection of all knitting needles for knit, tuck and miss at a knitting system, numerous pattern devices are already known. These consist essentially of cam system parts forming knit, tuck and miss tracks and mechanical, electronic or electromagnetic control means, by means of which the knitting implements are distribute to these tracks.

In most knitting machines which arc already known, which are designed for a three path technique, either a substantial increase in the system width and/or a comparatively expensive construction of the pattern devices or the associated needles or jack has to be accepted. Thus for example a knitting machine is known (DE 3 739 924 A1) in which the control jacks associated with the knitting needles firstly have to be distributed at a first selector station in accordance with a pattern to a miss track and to a cam system track leading to the tuck position and then in a second selector station be left in accordance with the pattern in the tuck track or diverted into a knit track. Against the advantage that knitting needles and control jacks well-tried in practice can be used, there is the disadvantage that the double selection involves substantially doubling the system width, which means a large loss in performance on account of the small number of systems in any case possible, e.g. 48 systems with a needle cylinder diameter of 30". This disadvantage can indeed be avoided by a likewise known circular knitting machine (DE 4 007253 C2), with makes the three-path technique possible without substantial system widening compared with the usual two-path technique. However such a knitting machine requires the use of special knitting needles with at least two pivotable control butts each instead of the generally used latch or slide needles, which is undesirable for reasons of cost.

Similar problems have arisen in the attempts to make other known selector devices previously used only for the two-path technique usable for the three-path technique. This applies for example to known selector devices (DE 3 712 673 C1) in which control jacks in the form of single arm levers are associated with the knitting needles and serve simultaneously as control elements and needle push-jacks. These control jacks are biased radially outwards by springs fitted in their backs, into a raise position and have to be swung on to the control magnet, which lie-s radially inside the needle circle, against the spring force before reaching the selection station, by means of a special presser race, which acts on rocking butts of the control jacks, in order thereby to lower the controllable raising butts into the needle tricks, i.e. swing them out into the working range of the cam system races. If such a selector device is used to make a double selection station, in that for example a second, corresponding selector device is arranged where the needles reach the tack position, a second presser cam system part must be associated with this second selector device, in order to swing the control jacks running in the tuck position away from the corresponding raise part and apply them to a second control magnet. This second presser cam system part does indeed not double the system width as in the first cited knitting machines, but has the result that in no case can 60, 64 or 72 systems be fitted round the periphery of a circular knitting machine with a needle cylinder diameter of 30", which is desirable for patterning reasons. In still further known knitting machines of this kind (DE-AS 1 760 405), which are also provided with control jacks in the form of single arm levers, each having a controllable raising butt, there is indeed the advantage that these already assume a position on reaching the tuck position which makes the use of a presser cam system part for the second control magnet unnecessary. A disadvantage with this solution is however the fact that the control jacks either each have to be provided on both sides with a spring or when using only one spring disposed on the front side of the control jacks, an additional tensioning cam system, part is needed for this, which results in a corresponding unfavourable system widening as does a presser cam system part for the control jacks.

Finally a knitting machine of the type initially recited has already been made known (DE 3 541 171 C2), in which the control jack is formed as a two-armed lever, where the one lever arm comprises the armature surface for the control magnet and the other lover arm comprises a rocking butt cooperating with a presser cam system part and a controllable raising butt cooperating with raise races. The control magnet is located in this case on the front side of the control jacks. The pattern device developed as a whole for the particular case of a flat knitting machine is of comparatively complex construction. The control jacks serve only as control elements but not as needle push-jacks. Only a preselection is effected by them and the control magnet while the transfer of the needles into the tuck or knit position is effected with other means and at a location lying after the double selector station. The double selection is here effected in that all control jacks are applied to the control magnet at the first selector station by means of a presser cam, in order to select and thus raise first control jacks by pattern-based control of the control magnet, while the other control jacks are held deflected by an associated retaining pole against the forces of the springs, until they reach the second selector station, where selection or raising of second control jacks takes place, while all other control jacks remain in a pass position. The controllable raising butts in each case effect only a comparatively short lift of the control jacks, while the actual separation of the control jacks selected to knit, tuck and miss, i.e. of the knitting needles associated therewith is effected in each case by means of an additionally present, second, non-controllable raising butt, which is formed on the lever arm of each control jack with the armature surface and always assumes a raise position regardless of the position of the controllable raising butt, as well as additional needle lifters which can likewise pivot.

Such a selector device accordingly does not only involve a substantial increase in the system width and in the expense of construction but also does not operate with sufficient reliability, at least when used on circular knitting machines, Since the control jacks are held tight between the two selector stations solely by the holding magnet, it is not possible reliably to avoid the control jacks dropping uncontrollably off the hold magnet because of the action of the springs, therefore causing pattern faults, when vibration unavoidably occurs in rapidly running circular knitting machines.

SUMMARY OF THE INVENTION

The invention is accordingly based on the object of so designing the control jacks of the kind initially specified that they facilitate the manufacture of a selector device.

A further object of this invention is to design the control jacks such that they are particularly suitable for fast running circular knitting machines having selector devices.

A further object of this invention is to design the control jacks such that they do not, if the three-path technique is implemented, substantially increase the system width compared with the ordinary two-path technique.

To solve these and other objects the invention provides to arrange the controllable raising butts of the control jacks on the first lever arms thereof.

The invention is based on the surprising recognition that, in order to solve the described problems, it is essentially only necessary to invert the selection principle underlying the control jacks of the type defined, i.e. so to provide the control that the control jacks assume their raise position and not their pass position when they lie on the magnet. This is easy to implement in that the controllable raising butt is provided on the lever arm with the armature surface, instead of on the lever arm with the rocking butt and the second, non-controllable raising butt is dispensed with. It is moreover possible through this to use the control jacks in a manner known per se simultaneously as a control element and as a needle push-jack. The desired tree-path technique can therefore be realised with means which are constructionally very simple, operate reliably even at high working speeds and can be made with a small system width.

Further advantageous features of the invention appear from the dependent claims.

The invention will now be explained in more detail in conjunction with the accompanying drawings of an embodiment;

BRIEF DESCRIPTION OF THE DRAWINGS

FIG. 2 is a schematic front view of two adjacent cam systems, seen from the side of the needle cylinder of the circular knitting machine according to FIG. 1;

FIG. 3 shows a knitting needle and a control jack in accordance with the invention associated therewith;

FIG. 4 is a plan view of adjacent presser cam systems parts of the cam systems according to FIG. 2;

DESCRIPTION OF PREFERRED EMBODIMENTS

Figure 1:
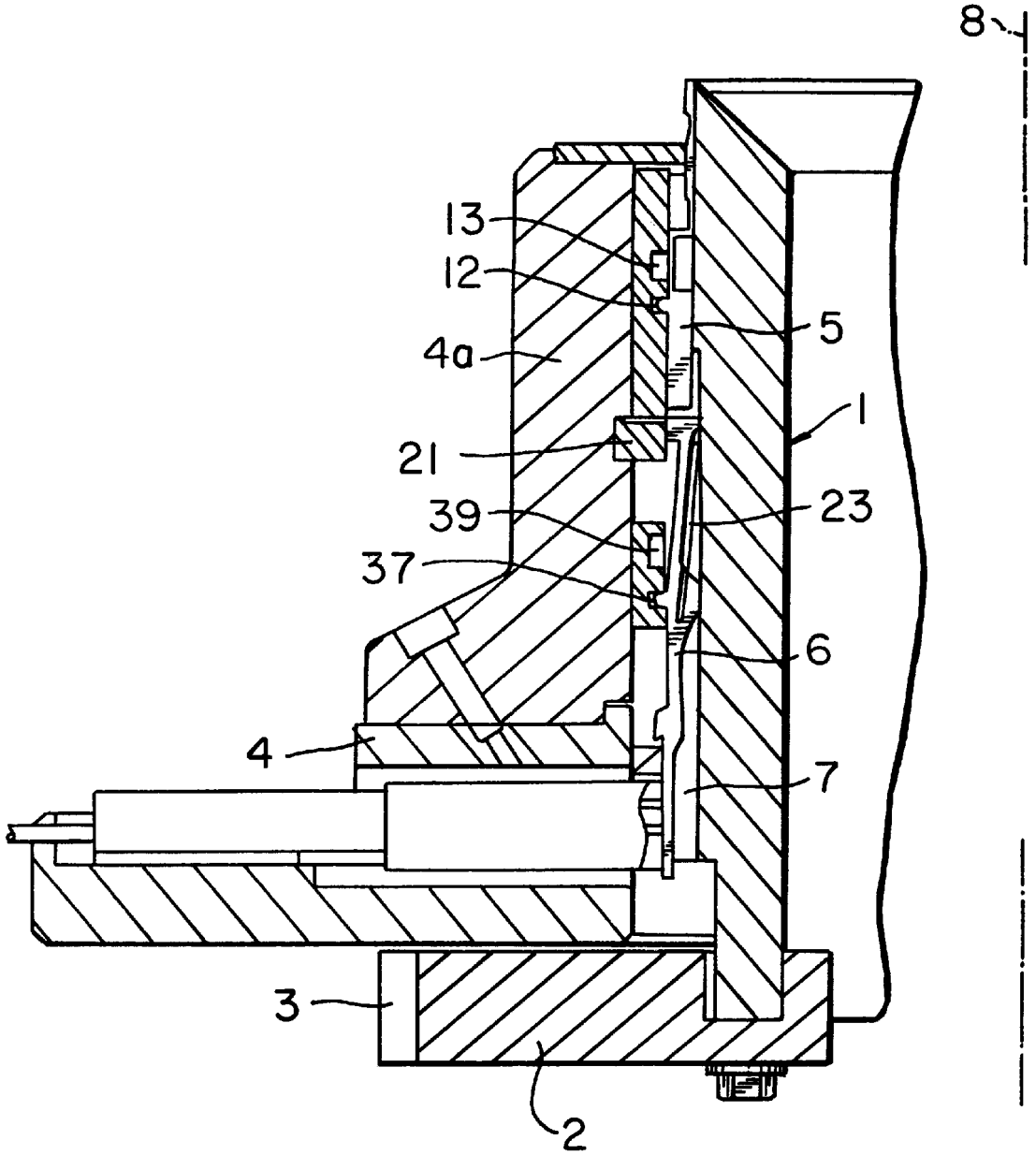
FIG. 1 is a highly schematic radial, vertical section through a circular knitting machine in the region of a selector device.

FIG. 1 shows a needle cylinder 1 of a circular knitting machine which cylinder is fixed on a support ring 2 mounted rotatably in a machine frame. The support ring 2 is provided with an outer ring of drive gear teeth 3, which are coupled through transmission gears or the like, not shown, to a drive motor. Cam system supports 4*a* associated with the individual knitting systems are mounted on a stationary cam system plate 4 mounted in the machine frame, with cam system parts mounted on the inside, which act on the butts of knitting needles 5 or other knitting implements and control jacks 6 associated therewith, where the needles 5 and control jacks 6 are arranged in tricks 7 of the needle cylinder 1 formed by webs or the like. The tricks 7 run parallel to the axis of rotation 8 of the needle cylinder 1. The needles 5 slidably are mounted parallel to the axis of rotation 8 in the tricks 7. The control jacks 6 are arranged in the tricks 7 underneath the needles 5 and are mounted not only to slide parallel to the axis of rotation 8 but also to pivot radially.

As FIGS. 2 to 4 in particular show, cam systems 9 and 10 are associated with the individual knitting systems of the circular knitting machine and can be of the same or different forms and of which only two are shown in FIG. 2 by way of example. In the embodiment the cam system 9 comprises a section in an upper region by means of which butts 11 of the needles 5 can be guided selectively into a pass or miss track 12 or be raised along a raise track 13, in order for example to receive a yam from a yarn feeder, not shown. The cam system 9 is provided to this end with lower and upper edges 14, 15 and a guard cam system part 16 lying therebetween.

Below the tracks 12, 13 the cam system 9 comprises a raise part 17 for controllable raising butts 18 of the control jacks 6. The selection between whether a needle 5 is to remain with its butt 11 in the pass track 12 or to go into the raise track 13 is effected in that the control jacks 6 is so pivoted in the tricks 7 that their butts 18 either stand out radially from the tricks 7 of the needle cylinder 1 (FIG. 1) and are thereby engaged by a raise edge 19 of the raise part 17 and are lifted (raise position of the control jacks 6), or are sunk radially into the tricks 7 and then pass the raise part 17 on its front side, without being lifted (pass position of the control jacks 6). In order to prepare the selection the control jacks 6 also each have a rocking butt 20 and the cam system 9 has a presser cam system part 21 shown in FIG. 4 in particular, which pivots the control jacks 6 in a first preselected position before their entry into a selector station, while a control magnet 22 serves to implement the selection. This magnet is arranged in the region of a selector station and serves either to hold the control jacks 6 passing thereby or to release them again, in accordance with the pattern, in which latter case they are swung away from the control magnet 22 under the action of springs 23.

Knitting machines of this kind are generally known and therefore do not need to be explained in more detail to the man skilled in the art (e.g. DE 3 541 171 C2 and DE 3 712 673 C1, whose contents are made part of the subject matter of the present disclosure in order to avoid repetition).

The control jack 6 in accordance with the invention consists essentially of an elongated shank which has a front side 26, a rear side 27 and a bearing point 28 in a middle section, which consists in essence of a bearing surface located on the rear side, by means of which the control jack 6 is so supported on the bottom of the trick 7, when it is arranged in the mounted state in the trick 7 (FIG. 1), that it can be pivoted about this bearing surface about an axis perpendicular to the axis of rotation 8. The bearing point 28 is accordingly formed to particular advantage as a circular arc on its rear side. Extending from the bearing point 28 are a first lever arm 29 projecting downwardly in the drawing and a second lever arm 30 projecting upwardly, so that the control jack 6 is formed as a two-armed lever. The first lever arm 29 has an armature surface 31 on its front side 26, which consists for example simply of a suitable section of the front face of the lever arm 29, and the controllable raising butt 18 which also projects to the front side and which is advantageously arranged between the armature surface 31 and the bearing point 28. On the other hand the second lever arm 30 is provided with the rocking butt 20, which preferably projects outwards beyond the front side 26 of the control jack 6. The spring 23 is moreover so arranged on the rear side of the second lever arm 30 that, when the control jack 6 is fitted in the corresponding trick 7 of the needle cylinder 1 (FIG. 1), it tends to swing the second lever arm 30 and thus the rocking butt 20 radially out of the trick 7 and at the same time to swing the controllable raising butt 18 radially inwards into the trick 7. The spring 23 can consist of flexible section formed in one piece with the control jack 6 or, as the drawings show, be made from a spring wire element, which has one end fitted into a slot-like recess 32 preferably near to the bearing point 28 and preferably firmly anchored therein. The spring 23 preferably has a curved section which forms a support surface 33 with its apex projecting to the rear side, with which the spring 23 can bear on the bottom of the associated trick 7.

Finally, it can be seen from the drawings that the control jack 6 is provided in the region of the bearing point 28 and the recess 32, but on its front side 26, with an additional clearing butt 34, preferably of circular arcuate form. The cam system 9 has additional cam systems parts 35 and 36 in a middle region corresponding to the position of the clearing butt 34 and thus disposed between the cam system part 17 and the presser part 21, by means of which the clearing butts 34 of the control jacks 6 can be guided into a pass track 37 or a raise track 39 separated therefrom by a guard cam system part 38, where the tracks 37, 39 correspond essentially to the tracks 12, 13 (FIG. 2). The height of the clearing butt 34 is preferably smaller than the distance between the bearing point 28 and the front side 26.

The cam system 10 and the cam systems associated with the other knitting systems, not shown in FIG. 2, arc formed correspondingly in the embodiment.

The mode of operation of the circular knitting machine explained above with reference to FIGS. 1 to 4 is essentially as follows:

With the needle cylinder 1 rotating and the cam system stationary the knitting needles 5 and control jacks 6 move in the direction of an arrow v in FIG. 2. The butts 11 of the needles 5 raised ahead in the direction of movement of the cam system 9 as well as the clearing butts 34 of the associated control jacks 6 are located on entry into the cam system 9 at the level of the pass tracks 12 and 37 respectively, since they were lowered in the preceding cam system by means of customary clearing parts 41 and clearing edges 42 of the cam system parts 36 respectively. The butts 11, 34 of needles 5 and control jacks 6 not raised in the preceding cam system are likewise at the level of the pass tracks 12 and 37 respectively. Regardless of this, the rocking butts 20 of all control jacks 6 come at the end region of the preceding cam system into the range of action of the presser cam system parts 21, which have radially inwardly rising presser surfaces 43 (FIG. 4) and therefore swing all rocking butts 20 radially inwards, against the force of the springs 23, into the associated tricks 7 of the needle cylinder. Accordingly the control jacks 6 mounted to pivot freely in the tricks 7 are so turned about the bearing points 28 into their raise positions that their armature surfaces 31 bear one after the other on the control magnet 22 and are released or retained by its control pole 44 (FIG. 2) in accordance with the pattern.

The control jacks 6 pertaining to the released armature surfaces 31 are turned about the bearing points 28 into the pass positions by the springs 23 in further travel, until their operating butts 18 are sunk filly into the tricks 7 and therefore cannot be engaged by the raise edge 19 of the cain systems parts 17. This can be seen above all from FIG. 5 and is facilitated in that the presser cam systems parts 21 have a gap or recess in this region, which allows the rocking butts 20 to emerge from the tricks 7. The section line VI—VI for FIG. 6 is Shown in the region of the cam system 10 in FIG. 2 for greater clarity, instead of in the region of the cam system 9, to which the present description relates. The corresponding operating butts 18 pass by the front side of the cam system part 17 during the further movement, without being raised thereby, so that the clearing butts 34 and the butts 11 of the needles 5 go into the corresponding pass tracks 37 and 12 respectively, The armature surfaces 31 not released by the control poles 44 are in contrast also retained during further passage by holding poles 45 arranged after the control poles 44, so that the control jacks 6 remain in their raise positions, as is shown in the section of FIG. 1 and also shown along the section line VI—VI, and then run, with their raising butts 18 onto the raise edge 19 of the cam system part 17 (FIG. 6). These control jacks 6 are therefore raised during the further passage along the raise edge 19. Accordingly upper acting edges 46 (FIG. 3) of the rocking butts 20 bear on the bottom edges of the associated needles 5 or other knitting implements (FIG. 6), so that these are correspondingly raised. Both the clearing butts 34 and the butts 11 of the needles 5 thus firstly enter the corresponding raise tracks 39 and 13 respectively, from which they are cleared again into the pass tracks 37 and 12 respectively by the clearing edges 42 and clearing part 41 respectively after completion of the raising.

A particular advantage of the described control jacks 6 or selector devices lies in that the controllable raising butts 18 are so arranged that the control jacks 6 assume their respective raise positions when they lie on the control magnet 22, By the expression "controllable" raising butts is to be understood that butts are concerned which are not in the raise position permanently and independent of the pivoted state of the control jacks 6, but assume either the raise position or the pass position, in which they are not engaged by the raise edge 18, in accordance with the pattern. On account of this arrangement of the raising butts 18, which lie like the armature surfaces 31 and the control magnet 22 on the front sides of the control jacks 6, it is possible to provide a second selector station within the cam system 9 or 10, without the system width or the width of the cam system 9, 10 being substantially increased. Such a second selector station can be arranged in the central part of the raise edge 19 and be so arranged that the raising butts 18 running on the raise edge 19 are subjected to a second selection in that they are, in accordance with the pattern, either left on the raise edge 19 or arc knocked off these, as is already known in a similar way for needles with rocking butts and selector devices of different construction (DE 4 007 253 A1). The control jacks 6 according to the invention are accordingly suitable above all for rapidly running circular knitting machines with a plurality of e.g. 60, 64 or 72 knitting systems for implementing the so-called three-path technique with selection of miss, tuck and knit, although the described control jack 6 is naturally also suitable for all other knitting machines with suitable selector devices.

Figure 5:
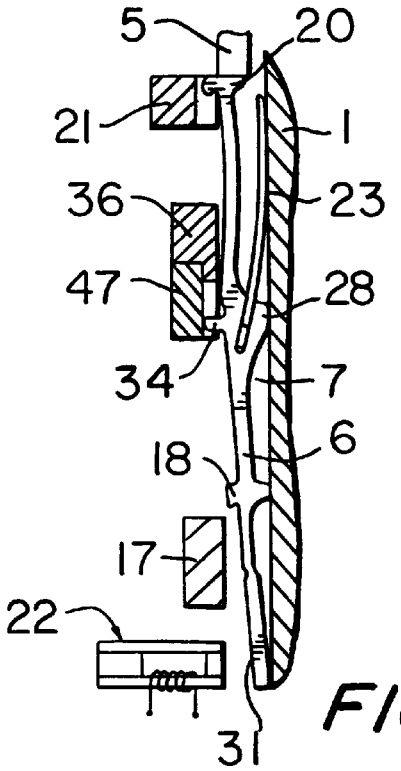
FIGS. 5 and 6 show radial vertical sections schematically, similar to FIG. 1, along the lines V—V and VI—VI of FIG. 2.
Figure 6:
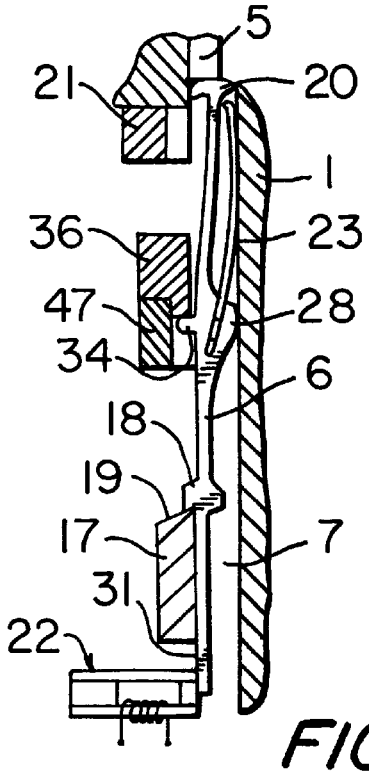

As FIGS. 5 and 6 in particular show, the cam system 9 preferably comprises a radially acting presser cam system part 47, on which the clearing butts 34 arranged in the region of the centre of gravity bearing point 28) bear from the inside. The presser cam system part 47 acts with its face side for example and is arranged at such a radial distance from the bottoms of the tricks 7 that the control jacks 6 are guided between it and the trick bottom with close play and therefore cannot undergo any uncontrolled radial movements. The front sides of the clearing butts 34 and the rear sides of the bearing points 28 can he of circular arc form, in order thus to ensure easy ability to pivot of the control jacks 6.

In order that the control jacks 6 retained by the control magnet 22 do not experience undesirable radial rebounds when they impinge during the further movement on the raise edge 19 and are then raised thereby, it is possible to shape the lower sides of the raising butts 18 and correspondingly the upper side of the raise edge 19 with a dovetail form, i.e. to provide theme with wedge-shaped, inclined surfaces 48, 49, which engage in hook fashion with one another during raising of the control jacks 6 (FIG. 7) and form an interlocking connection in the radial direction. In this case the control jacks 6 are preferably held in a slightly raised position during the selection process (FIG. 1), so that they can swing into the pass position without impediment with corresponding control of the control magnet 22. The raising of the control jacks 6 can be effected with aid of a cam race acting on the clearing butt 34.

Figure 7:
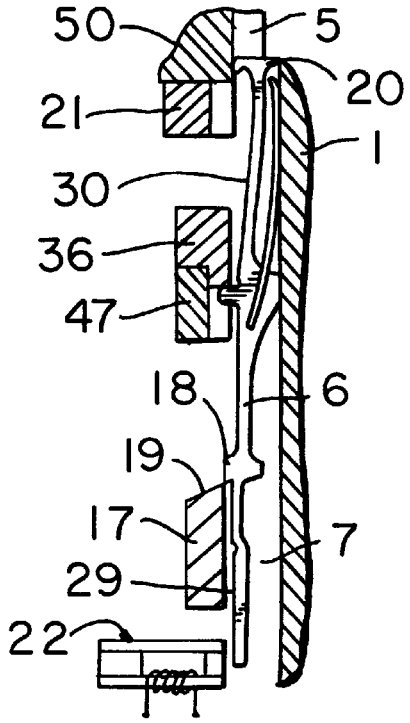
FIGS. 7 and 8 are schematic partial vertical sections corresponding to FIGS. 5 and 6 with a preferred detail of the invention.

In order that the control jacks 6 do not have to be pulled for reasons of reliability away from the control magnet 22 and held during the whole raising operation, there is further provided a cam system part 50 comprising the upper edge 14 (FIG. 2), with its underside so closely above the presser cam system part 21 that it covers the rocking butt 20 when swung in from the outside, as soon as the control jacks 6 have their raise butts 18 running on to the raise edge and are raised somewhat thereby (FIG. 7). An unwanted radially outwards turning back of the upper lever arms 30 under the action of the springs 23 is hereby avoided even when the retaining poles 45 (FIG. 2) of the control magnet 22 are not fully effective along the raise edge 19 and/or the lower lever arms 29 of the control jacks 6 tend to swing radially inwards from the cam system part 17 because of shocks, vibration or the like.

Figure 8:
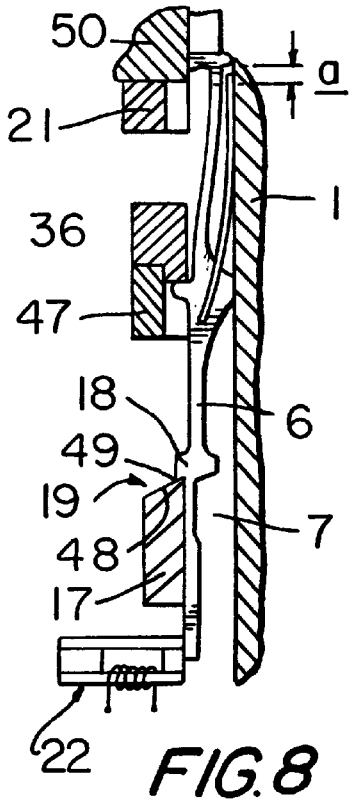

According to a particularly preferred embodiment it is finally provided so to design the springs 23 and arrange them on the control jacks 6 that the direction of force of the springs 23 reverses in the region of the raise edge 19. The arrangement is so designed for this that a distance a (FIG. 8) measured in each case parallel to the axis of rotation 8 of the needle cylinder 1 is provided between the rocking butts 20 and the support surfaces 33 and the support surfaces 33 are arranged below the rocking butts 20, i.e. at locations between the rocking butts 20 and the bearing points 28. If the cam system part 50 acts on the control jacks 6 against the force of the springs 23 in this case, a turning moment clockwise in FIG. 8 results, which is opposed to the turning moment normally developed by the springs 23, acting anticlockwise, and bringing the raising butts 18 reliably out of positions in which they do not bear fully on the raise edge 19 as is indicated in FIG. 7, into firm seating on the raise edge 19 or holds them securely in this (FIG. 8).

The substantial advantage arising from the described inversion of the action of the springs 23 is that the cam system part 50 does not have to bear on the rocking butt 20 with tight play. Even if they were to have a certain spacing from the fully swung back rocking butts 20, the resulting turn moment would always tend to advance the control jacks 6 clockwise in FIGS. 5 to 8 and therefore closer to the cam system part 17.

The invention is not limited to the described embodiment, which can be modified in numerous ways, This applies in particular to the action of the control jacks 6 on the knitting needles 5 shown in the drawings, instead of which other knitting implements, e.g. additional needle lifters, plush hooks or the like could be provided. Furthermore the described control jacks 6 can be used instead of in circular knitting machines with rotating needle cylinders also in circular knitting machines with rotating cam systems, in circular knitting machines with a second knitting implement carrier in the form of a rib dial or in flat knitting machines, as well as for purposes other than selection between miss, tuck and knit, especially for example for the selection of needles, which are for example to be brought into a transfer position. Finally it will be understood that the individual features can be used also in combinations other than those illustrated and described.

It will be understood that each of the elements described above, or two or more together, may also find a usefull application in other types of constructions differing from the types described above.

While the invention has been illustrated and described as embodied in a selector device for circular knitting machines, it is not intended to be limited to the details shown, since various modifications and structural changes may be made without departing in any way from the spirit of the present invention.

Without further analyses, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control jack for a knitting machine having at least one selector device for knitting implements, comprising: a front side (26), a rear side (27), a first lower lever arm (29) having a controllable raising butt (18) and an armature surface (31), a second upper lever arm (30) having a rocking butt (20), and a spring (23) arranged on the rear side (27) for biasing the second lever arm (30), wherein said arms (29, 30) are arranged on opposite sides of a bearing point (28) and wherein said controllable raising butt (18), said rocking butt (20) and said armature surface (31) are formed on the front side (26).

2. A control jack according to claim 1, wherein said controllable raising butt (18) has a dovetail shape.

3. A control jack according to claim 1, wherein said spring (23) is provided with a support surface (33) arranged between said rocking butt (20) and said bearing poult (28).

4. A control jack according to claim 1 and further comprising a clearing butt (34) arranged in the region of said bearing point (28).

5. A control jack according to claim 1 and further comprising a slit-like recess (32), wherein said spring (23) is made from a spring wire element which is arranged with one end in said recess (32).

6. A control jack according to claim 1, wherein said spring (23) has a curved section forming the support surface (33).

7. A control jack according to claim 1, wherein said controllable raising butt (18) is arranged between the armature surface (31) and bearing point (28).

8. A control jack according to claim 1, wherein said rocking butt (20) projects beyond its front side (26).

9. A control jack according to claim 1, wherein said rocking butt (20) is provided on an upper side with an acting edge (46) for controlling a knitting implement (5).

10. A control jack according to claim 4, wherein said spring (23) is connected thereto in the region of said bearing point (28) and said clearing butt (34).

11. A control jack according to claim 4, wherein said clearing butt (34) has a height which is smaller than a distance between said bearing point (28) and said front side (26).

12. A control jack according to claim 1, wherein said bearing point (28) has a circular arcuate form on said rear side (27).

13. A control jack according to claim 4, wherein said clearing butt (34) has a circular arcuate form on the front side (26).

14. A control jack according to claim 1, wherein said spring (23) is provided with a support surface (33) arranged between said rocking butt (20) and said bearing point (28) in such a manner that the direction of spring force is reversed and a turning moment results which is opposed to that of a turning moment normally developed by the spring (23).

* * * * *